US006295992B1

(12) United States Patent
Sapp

(10) Patent No.: US 6,295,992 B1
(45) Date of Patent: Oct. 2, 2001

(54) HAIR BAND

(76) Inventor: Leslie R. Sapp, 3400 Honeysuckle Ct., Ann Arbor, MI (US) 48103

( * ) Notice: Subject to any disclaimer, the term of this patent is extended or adjusted under 35 U.S.C. 154(b) by 0 days.

(21) Appl. No.: 09/535,876

(22) Filed: Mar. 28, 2000

(51) Int. Cl.[7] ..... A45D 8/36
(52) U.S. Cl. ..... 132/200; 132/275
(58) Field of Search ..... 132/273, 275, 132/200; 2/DIG. 11, 174, 170

(56) References Cited

U.S. PATENT DOCUMENTS

| | | | | |
|---|---|---|---|---|
| D. 292,030 | | 9/1987 | Revson . | |
| D. 315,036 | | 2/1991 | Leopold . | |
| D. 317,663 | | 6/1991 | Calderon . | |
| D. 343,949 | | 2/1994 | Weingrod . | |
| D. 348,330 | | 6/1994 | Marrese . | |
| D. 348,331 | | 6/1994 | Marrese . | |
| D. 348,749 | | 7/1994 | Novick . | |
| D. 354,153 | | 1/1995 | Marrese . | |
| D. 355,974 | | 2/1995 | Jahn . | |
| D. 357,092 | | 4/1995 | Young . | |
| D. 362,738 | | 9/1995 | Marrese et al. . | |
| D. 364,705 | | 11/1995 | Frame et al. . | |
| D. 389,954 | | 1/1998 | McClean . | |
| 4,068,318 | * | 1/1978 | McMahon | 2/170 |
| 4,656,671 | * | 4/1987 | Manges | 2/174 |
| 4,977,625 | * | 12/1990 | Charters, III | 2/170 |
| 5,044,385 | | 9/1991 | Rhodes . | |
| 5,465,741 | | 11/1995 | Dvorak . | |
| 5,622,194 | | 4/1997 | Ledda-Vengerder . | |
| 5,823,012 | * | 10/1998 | Hacskaylo | 2/DIG. 11 |
| 5,826,277 | * | 10/1998 | Mc Conville | 2/DIG. 11 |
| 5,927,296 | * | 7/1999 | Maturaporn | 132/273 |
| 5,963,989 | * | 10/1999 | Robertson | 2/DIG. 11 |

* cited by examiner

*Primary Examiner*—Todd E. Manahan
(74) *Attorney, Agent, or Firm*—Brinks Hofer Gilson Lione

(57) ABSTRACT

An elongated member having a first side portion, a second side portion disposed opposite the first side portion, and a center portion disposed between the first side portion and the second side portion. A first edge surface is disposed along the first side portion, and a second edge surface is disposed along the second side portion and disposed opposite the first edge surface. The first side portion and the second side portion are folded across and fastened to the center portion such that the first edge surface and the second edge surface are substantially adjacent and substantially hidden from a vantage at a distance from the hair band.

22 Claims, 2 Drawing Sheets

HAIR BAND

TECHNICAL FIELD OF THE INVENTION

This patent discloses and claims a useful, novel, and unobvious invention for a hair band in the hair fastener field.

BACKGROUND

As shown by the tremendous commercial success of the so-called "scrunchie", many young and adult women prefer to hold their hair in a ponytail with an ornamental hair band. Although there are many variations of such hair bands, none of the hair bands solve the problem of holding hair in a ponytail away from the face and off the neck of a user during physical activity, such as running and playing basketball. The hair bands of the conventional techniques in the art all require adjustment during any physical activity, because the hair of the ponytail tends to slip or fall out. These hair bands fail to properly hold hair during physical activity because of their low modulus of elasticity and their high bulk. Their modulus of elasticity (as defined by as the ratio of the stretching force per unit cross-sectional area to the elongation per unit length) allows them to easily fit over hair, but prevents them from holding hair during physical activity. Their bulk, typically made of gathered fabric, weighs them down and tends to pull these hair bands off the head of the user. Thus, there is a need for a hair band with the appropriate modulus of elasticity and a minimal bulk to properly hold hair in a ponytail during physical activity.

SUMMARY OF THE INVENTION

Accordingly, this invention provides for a hair band that overcomes the problems and disadvantages of the conventional techniques in the art. The invention also provides for a hair band with an appropriate modulus of elasticity and a minimal bulk to properly hold hair in a ponytail during physical activity. The invention also provides for a hair band with a portion that forms a label to identify the source of the band. The invention also provides for a hair band that limits the absorption of excess sweat during physical activity of the user.

Briefly, the invention includes an elongated member having a first side portion, a second side portion disposed opposite the first side portion, and a center portion disposed between the first side portion and the second side portion. A first edge surface is disposed along the first side portion, and a second edge surface is disposed along the second side portion and disposed opposite the first edge surface. The first side portion and the second side portion are folded across and fastened to the center portion, such that the first edge surface and the second edge surface are substantially adjacent and substantially hidden from a vantage at a distance from the hair band. In this manner, the hair band has an appropriate modulus of elasticity and a minimal bulk to properly hold hair in a ponytail during physical activity.

BRIEF DESCRIPTION OF THE DRAWINGS

Further features and advantages of the invention will become apparent from the following discussion and accompanying drawings, in which.

DETAILED DESCRIPTION OF THE PREFERRED EMBODIMENT

The following description of the preferred embodiment is merely exemplary in nature, and is in no way intended to limit the invention or its application or uses.

Figure 1:
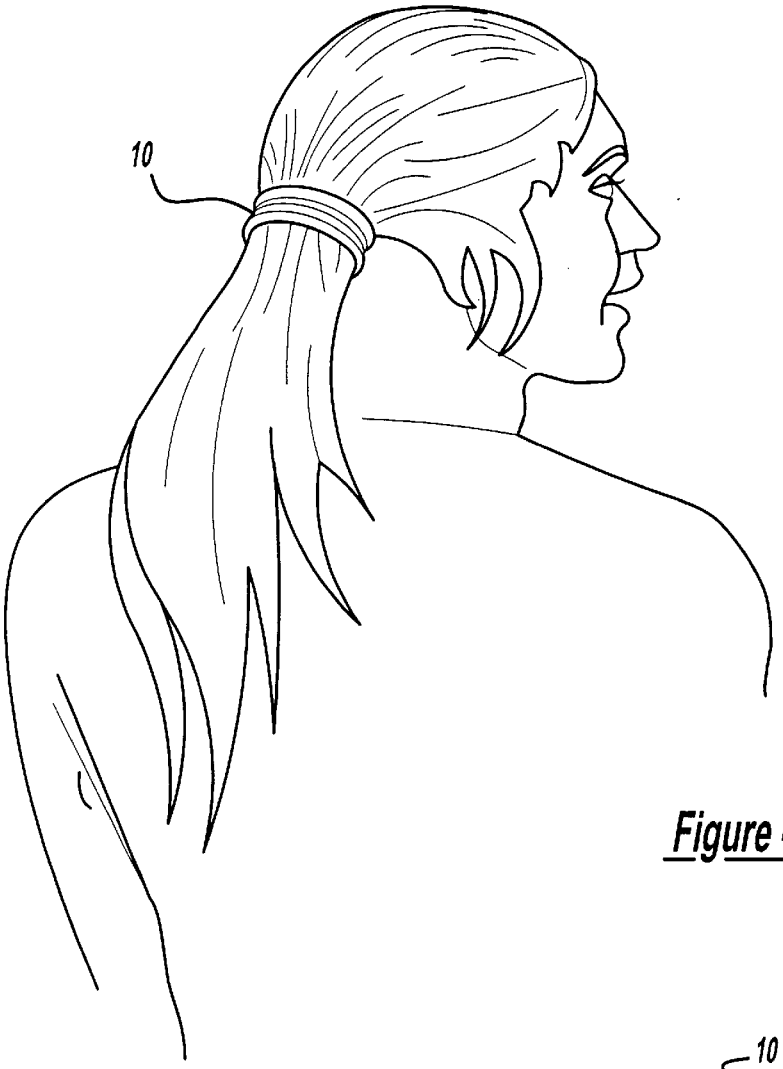
FIG. 1 is a view of the hair band of the preferred embodiment of the invention properly holding the hair of a user in a ponytail.

As shown in FIG. 1, the band 10 of the preferred embodiment of the invention may be used as a hair band to hold the hair of a so-called ponytail. In this application, the band 10 may be designed to wrap once around thicker hair, and to wrap twice around thinner hair. The band 10 may be alternatively used as a wrist band or a head band. In these alternative applications, the band 10 would be designed as a wrist band to fit over a typical hand and to fit snugly on a typical wrist, or designed as a head band to fit snugly on a typical head. The band 10, of course, may be used for any other suitable application.

Figure 2:
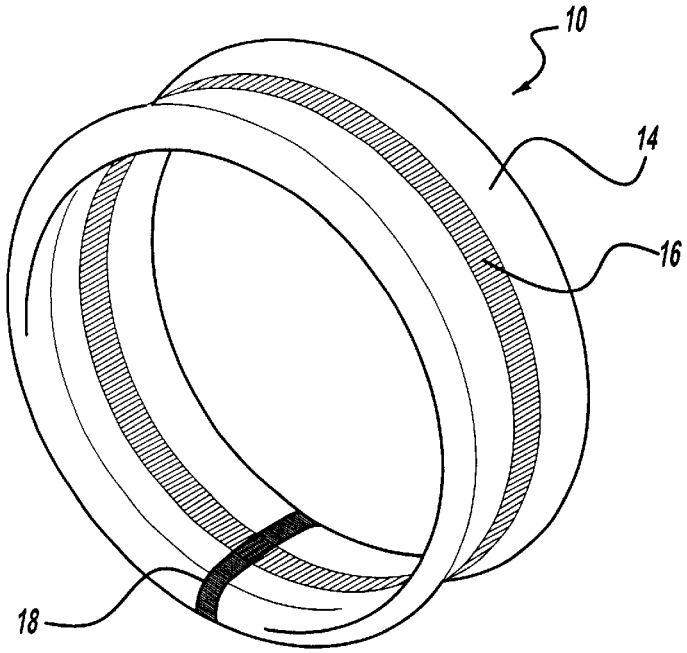
FIG. 2 is a perspective view of the preferred embodiment of the invention.
Figure 3:
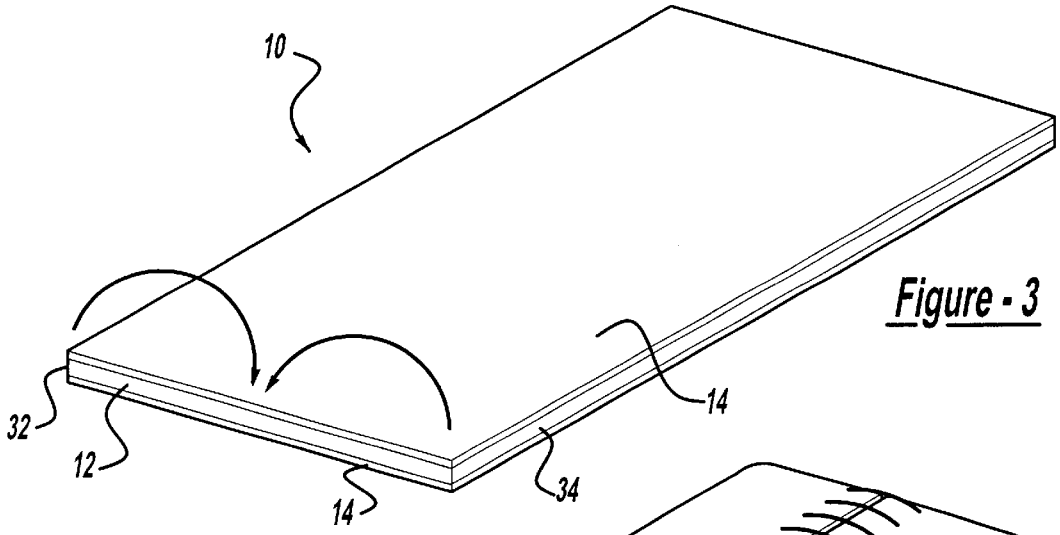
FIG. 3 is a perspective view of the elongated member and the skin member of the preferred embodiment of the invention.

As shown in FIGS. 2 and 3, the band 10 of the preferred embodiment of the invention includes an elongated member 12, a skin member 14, a first thread member 16, and a second thread member 18. The elongated member 12, when the band 10 is used as a hair band, functions to provide just enough modulus of elasticity to be stretched over hair and to firmly hold hair during physical activity, such as running. The elongated member 12 is preferably made from a closed-cell polymer, such as a neoprene material, which provides the appropriate modulus of elasticity of about 10 psi at 100% elongation. The band 10 may be alternatively made from other suitable materials, or may be made from a combination of suitable materials, such as a neoprene material and a butyl material. The elongated member 12, when made from a neoprene material preferably has a minimum tensile strength of about 70 psi and is preferably water-resistant and buoyant. In conventional hair bands, the absorption of excess sweat causes sanitary problems, such as odors and bacteria growth, and affects the modulus of elasticity and the bulk, which hinders the ability to properly hold hair. The water-resistant feature of the elongated member 12 limits the band 10 from absorbing excess sweat during physical activity of the user, and allows the band 10 to avoid these problems of conventional hair bands. The buoyancy feature of the elongated member 12 facilitates easy location and retrieval of the band 10 if ever accidentally dropped in a large body of water, such as a swimming pool or a lake. The neoprene material is preferably provided by the Rubatex Corporation under the tradename R-008-N, which is U.L. listed for personal floatation devices.

The skin member 14 functions to increase the durability of the elongated member 12, to increase the modulus of elasticity of the elongated member 12, and to provide a surface pleasant to the eyes and the touch. The skin member 14 is preferably made from a nylon material, but may be alternatively made from other suitable materials or from a combination of other materials, such as a nylon material and a spandex material. The skin member 14 is preferably laminated on both sides of the elongated member 12 with conventional methods, but may be alternatively fastened to only one side of the elongated member 12, or may be alternatively fastened with other suitable methods.

Figure 4:
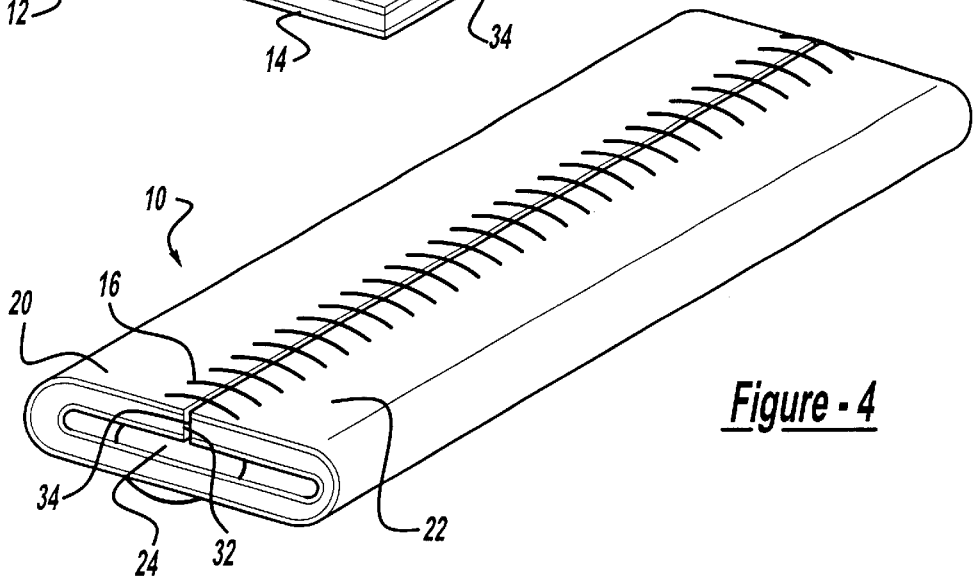
FIG. 4 is a perspective view of the elongated member, the skin member, and the first thread member of the preferred embodiment of the invention.
Figure 5:
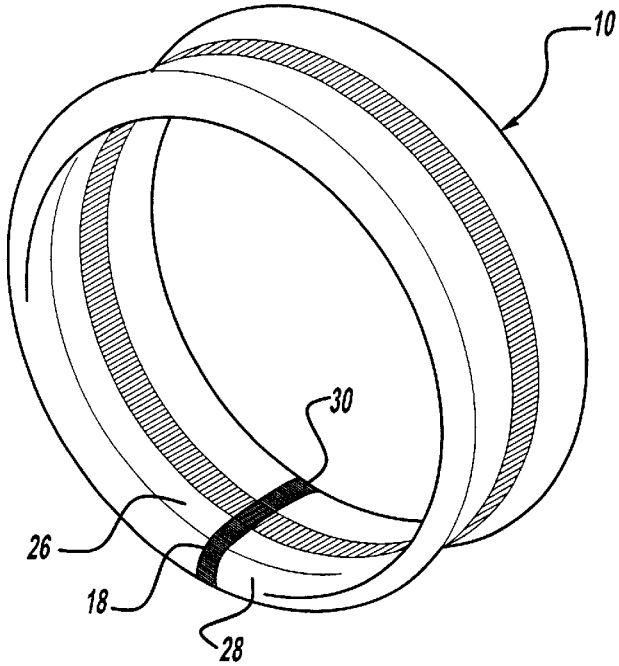
FIG. 5 is a perspective view of the preferred embodiment of the invention.

As shown in FIG. 4, the first thread member 16 functions to fasten a first side portion 20 and a second side portion 22 to a center portion 24 of the band 10. In the preferred embodiment, the first thread member 16 also fastens the first side portion 20 of the band 10 to the second side portion 22 of the band 10. As shown in FIG. 5, the second thread member 18 functions to fasten a first end 26 of the band 10 to a second end 28 of the band 10. In the preferred embodiment, the second thread member 18 forms a label 30, which functions to identify the source of the band 10. In an alternative embodiment, the label 30 may be formed independently and later fastened to the band 10 near the first end 26 and the second end 28 to cover the second thread member 18, or may be fastened at any other suitable location. The first thread member 16 and the second thread member 18 are preferably made from a cotton material covered with a polyester material. Either the first thread member 16 or the second thread member 18 may be alternatively made, however, with other suitable materials.

The method of making the band 10 of the preferred embodiment of the invention preferably includes three major steps. As shown in FIG. 3, step (a) includes providing the elongated member 12 preferably having the first side portion 20, the second side portion 22 disposed opposite the first side portion 20, and the center portion 24 disposed between the first side portion 20 and the second side portion 22. Preferably, a first edge surface 32 is disposed along the first side portion 20, and a second edge surface 34 is disposed along the second side portion 22 and is disposed opposite the first edge surface 32. As shown in FIG. 4, step (b) includes folding the first side portion 20 and the second side portion 22 over the center portion 24. Step (c) includes fastening the first side portion 20 and the second side portion 22 to the center portion 24, such that the first edge surface 32 and the second edge surface 34 are substantially adjacent and substantially hidden from a vantage at a distance from the band 10. In the preferred method, the first side portion 20 is fastened to the second side portion 22.

Once formed, the invention provides for a band with an appropriate modulus of elasticity and a minimal bulk to properly hold hair in a ponytail during physical activity.

The foregoing discussion discloses and describes a preferred embodiment of the invention. One skilled in the art will readily recognize from such discussion, and from the accompanying drawings and claims, that changes and modifications can be made to the invention without departing from the true spirit and fair scope of the invention as defined in the following claims.

I claim:

1. A band for use as a hair band, a wrist band, or a head band, comprising an elongated member having a first side portion, a second side portion disposed opposite said first side portion, a center portion disposed between said first side portion and said second side portion, a first edge surface disposed along said first side portion, and a second edge surface disposed along said second side portion and disposed opposite said first edge surface, said first side portion and said second side portion being folded across and fastened to said center portion, and said first edge surface and said second edge surface being substantially adjacent and substantially hidden from a vantage at a distance from the band.

2. The band of claim 1 wherein said first side portion is fastened to said second side portion.

3. The band of claim 1 further comprising a thread member sewn to said first side portion.

4. The band of claim 3 wherein said thread member is also sewn to said center portion for fastening said first side portion to said center portion.

5. The band of claim 4 wherein said thread member is also sewn to said second side member for fastening said first side portion to said second side portion.

6. The band of claim 1 wherein said elongated member is made of a closed-cell polymer.

7. The band of claim 6 wherein said elongated member is made of a neoprene material.

8. The band of claim 1 wherein said elongated member is made of a water-resistant material.

9. The band of claim 1 wherein said elongated member is made of a buoyant material.

10. The band of claim 1 wherein said elongated member is made of a material with a modulus of elasticity of about 10 psi.

11. The band of claim 1 wherein said elongated member is made of a material with a minimum tensile strength of about 70 psi.

12. The band of claim 1 further comprising a skin member fastened to said elongated member.

13. The band of claim 12 wherein said skin member is made of a nylon material.

14. The band of claim 12 wherein said skin member is laminated to said elongated member.

15. A method of making a band for use as a hair band, a wrist band, or a head band, comprising the steps of:

(a) providing an elongated member having a first side portion, a second side portion disposed opposite the first side portion, a center portion disposed between the first side portion and the second side portion, a first edge surface disposed along the first side portion, and a second edge surface disposed along the second side portion and disposed opposite the first edge surface;

(b) folding the first side portion and the second side portion over the center portion; and (c) fastening the first side portion and the second side portion to the center portion such that the first edge surface and the second edge surface are substantially adjacent and substantially hidden from a vantage at a distance from the band.

16. The method of claim 15 wherein said step (c) includes fastening the first side portion to the second side portion.

17. The method of claim 15 wherein said step (a) includes providing an elongated member made of a neoprene material.

18. The method of claim 15 wherein said step (a) includes providing an elongated member made of a buoyant material.

19. The method of claim 15 wherein said step (a) includes providing an elongated member made of a material with a modulus of elasticity of about 10 psi.

20. The method of claim 15 further comprising the step of:

(d) providing a skin member and laminating the skin member to the elongated member.

21. The method of claim 20 wherein said step (d) includes providing a skin member made of a nylon material.

22. The method of claim 15 wherein said step (c) includes sewing the first side portion and the second side portion to the center portion.

* * * * *